US006227733B1

(12) United States Patent
Holloway

(10) Patent No.: US 6,227,733 B1
(45) Date of Patent: May 8, 2001

(54) LIPSTICK DISPENSER WITH FUNCTIONAL A-SHELL

(75) Inventor: Thomas F. Holloway, Southport, CT (US)

(73) Assignee: Crown Cork & Seal Technologies Corporation, Oxon (GB)

( * ) Notice: Subject to any disclaimer, the term of this patent is extended or adjusted under 35 U.S.C. 154(b) by 0 days.

(21) Appl. No.: 09/307,297

(22) Filed: May 7, 1999

(51) Int. Cl.[7] ..... A45D 40/04; A45D 40/06

(52) U.S. Cl. ..... 401/75; 132/318; 401/86; 401/87; 401/88

(58) Field of Search ..... 401/68, 75, 77, 401/78, 87, 88, 98; 132/318

(56) References Cited

U.S. PATENT DOCUMENTS

| | | | | |
|---|---|---|---|---|
| 2,980,246 | * | 4/1961 | Leshin | 401/75 |
| 3,256,980 | | 6/1966 | Bau | 206/56 |
| 3,275,132 | | 9/1966 | Hultgren | 206/56 |
| 3,310,168 | * | 3/1967 | Landen | 401/78 X |
| 3,807,881 | | 4/1974 | Seidler | 401/175 |
| 3,907,441 | * | 9/1975 | Idec et al. | 401/75 |
| 5,018,893 | | 5/1991 | Holloway | 401/75 |
| 5,437,513 | * | 8/1995 | Favre | 401/75 X |
| 5,551,787 | * | 9/1996 | Rosenthal | 401/75 X |

FOREIGN PATENT DOCUMENTS 1351560 12/1963 (FR) .

* cited by examiner

*Primary Examiner*—Gregory L. Huson
*Assistant Examiner*—Kathleen J. Prunner
(74) *Attorney, Agent, or Firm*—St. Onge Steward Johnston & Reens

(57) ABSTRACT

A lipstick dispenser uses the normally decorative A-shell as a functional element by providing a plurality of longitudinal splines in the interior of the A-shell. The splines fit into notches in an elevator cup to keep the elevator in fixed relationship to the A-shell. A propel/retract mechanism is provided by lugs extending from the elevator that track in helical tracks in a base that is secured together with the A-shell. The base has flexible upwardly extending friction tabs that ride on the inside of the A-shell and provide a desired frictional drag.

16 Claims, 3 Drawing Sheets

FIG. 9
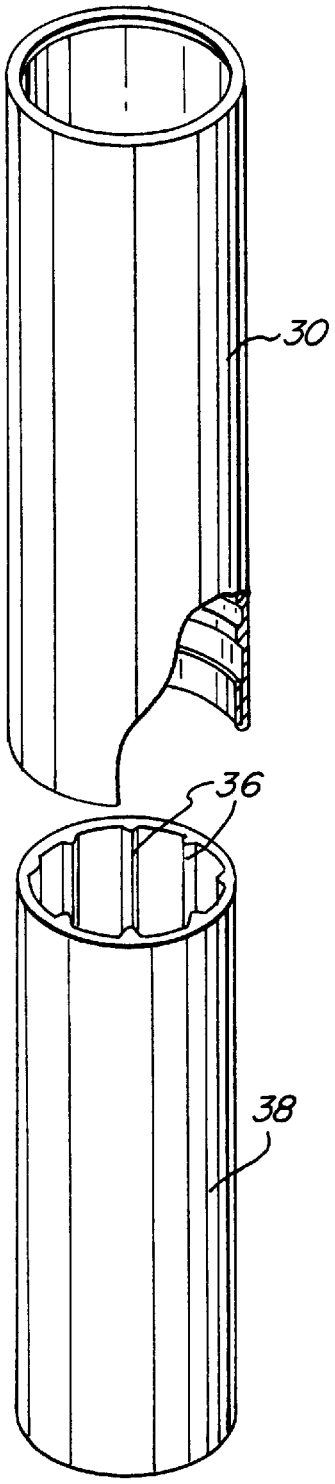
FIG. 8
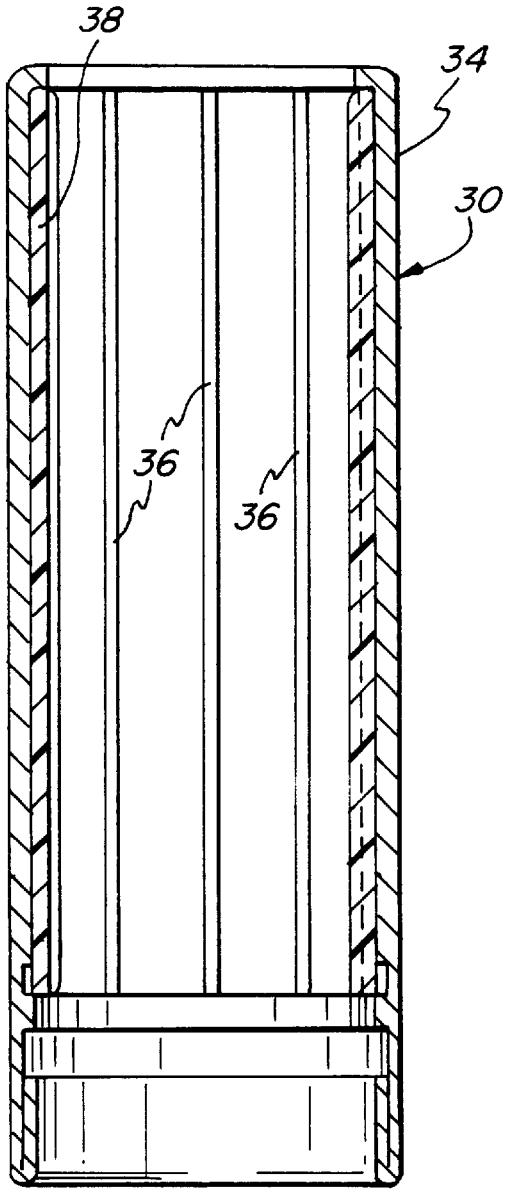
FIG. 7

LIPSTICK DISPENSER WITH FUNCTIONAL A-SHELL

FIELD OF THE INVENTION

The present invention relates to the field of lipstick and cosmetic dispensers having a propelling and retracting mechanism for a cosmetic stick contained within the dispenser.

BACKGROUND OF THE INVENTION

There has been a trend in the cosmetics product market towards "non-transferable" lipstick products. These products are heavy, silicone filled lipsticks that do not transfer from the wearers lips, and leave residue, such as on a coffee cup or clothing. These lipstick formulations have a significant quantity of volatile components in their formulations. As such, they must be kept enclosed in an airtight container when not in use. If not enclosed in an airtight container, they will dry out and shrink. They will become unusable to the consumer, particularly if the lipstick shrinks and falls out of the dispenser cup. These products were first introduced to the market in slim lipstick dispensers because these dispensers had the necessary airtight construction. However, these initial slim dispenser designs also have disadvantages. These slim dispenser designs typically include an elevator cup that has a threaded rod extending downwardly into and engaging a threaded base element, and which can be operated with a twisting action to extend the cosmetic stick from a nose member. One such design is shown, for example, in my U.S. Pat. No. 5,018,893.

A disadvantage of these designs is that in order to load the dispenser with a cosmetic stick, the cosmetic stick must be formed and carefully loaded into the dispenser or cast in place in the tubular nose of the dispenser. The elevators of these dispensers cannot be bottom filled with a molten cosmetic product which is allowed to cool, in place, in a mold, so that the cosmetic is molded in place onto an elevator cup. It is to be appreciated that bottom filling of an elevator cup of a cosmetic dispenser is considered a preferred method of loading the cosmetic stick into a lipstick dispenser because it simplifies the cosmetic loading operation and reduces product loss arising from breakage of the cosmetic stick on loading. Such bottom filling methods are used with conventional lipstick dispensers where the cup size is on the order of 0.50 inches diameter. Such bottom filling methods are not generally usable in slim dispenser designs because they will use a small diameter solid threaded rod element engaged in a cam or nut element to drive the elevator. In contrast, the conventional dispensers use a combination of an innerbody with straight tracks working in combination with helical tracks on a cam sleeve to move an elevator cup by engagement with the elevator cup lugs.

Lastly, the "feel" of the existing slim dispenser designs is sometimes slack; desirably, a cosmetic dispenser should have a sufficient amount of swivel drag to give the dispenser a feel that is smooth and luxurious.

SUMMARY OF THE INVENTION

It is an object of a preferred embodiment of the invention to provide a slim cosmetic dispenser which is capable of being bottom filled with a molten cosmetic product to allow a cosmetic stick to be formed in place in the elevator cup of the dispenser. It is an object of a preferred embodiment of the invention to provide such a dispenser with an enhanced swivel drag. It is an object of the preferred embodiment of the invention to provide such a dispenser which seals to prevent premature drying and deterioration of a cosmetic stick.

These objects, and other objects which shall become apparent hereafter are accomplished by a cosmetic dispenser in accordance with one embodiment of the invention, comprising a tubular A-shell, an elevator and a base.

The A-shell is preferably a decorative aluminum A-shell, but has a plurality of longitudinal splines provided with the interior wall of the A-shell, either as ribs formed integrally with the wall, or as part of a plastic insert. Preferably, there are from four to eight of such splines. The elevator has an elevator cup at an upper end and an elevator stem extending down from the cup. The elevator stem is preferably hollow, and open at its lower end.

The elevator cup is fitted inside the A-shell and has a plurality of notches around its outer wall. The longitudinal splines fit into the notches to keep the elevator cup in a fixed orientation relative to the A-shell. In one preferred embodiment, the elevator cup notches are formed in an annular bead extending around the outer wall of the elevator cup; for ease of manufacture, the bead is deformable, and the elevator cup notches are made by the pressure of the A-shell splines on the bead when the cosmetic dispenser is operated. In another embodiment, the elevator cup notches are molded or otherwise formed in the outer wall of the elevator cup.

The elevator stem has an exterior wall with a circular cross-section and lugs extending radially outwardly therefrom which fit into and follow an internal helically threaded track of the base. The base is rotatably-attached to the A-shell, preferably by an annular bead extending around a perimeter of the interior wall of the A-shell in snap fitting engagement with a channel extending around a perimeter of an outer wall of the base. Accordingly, the cosmetic dispenser is operable to cause the elevator cup to travel longitudinally in the A-shell by rotation of the base element relative to the A-shell, because the rotation causes the lugs to track upwardly in the helically threaded track, with the A-shell splines received in the elevator cup notches maintaining the elevator cup in a fixed orientation relative to the A-shell.

In a preferred embodiment, a desired swivel torque is provided by a plurality of separate tabs formed with and extending upwardly from the base into frictional contact with the interior wall of the A-shell to generate friction between the base and the A-shell upon relative rotation of the base and A-shell.

The invention reduces the number of parts used in a dispenser by eliminating the innerbody found in most conventional lipstick dispensers. It provides a slender appearance and an airtight option. It provides a desirable feel due to the friction of plastic friction tabs against a metal A-shell.

Other objects, aspects and features of the invention in addition to those mentioned above will be pointed out in or will be understood from the following detailed description in conjunction with the drawings.

BRIEF DESCRIPTION OF THE DRAWINGS

FIG. 7 is a cross-sectional elevation view of an A-shell and insert of a lipstick dispenser in accordance with another embodiment of the invention.

FIG. 8 is a perspective view of the insert for an A-shell of FIG. 7.

FIG. 9 is a perspective view with partial cross-section of the A-shell of FIG. 7.

DETAILED DESCRIPTION OF THE INVENTION

Figure 1:
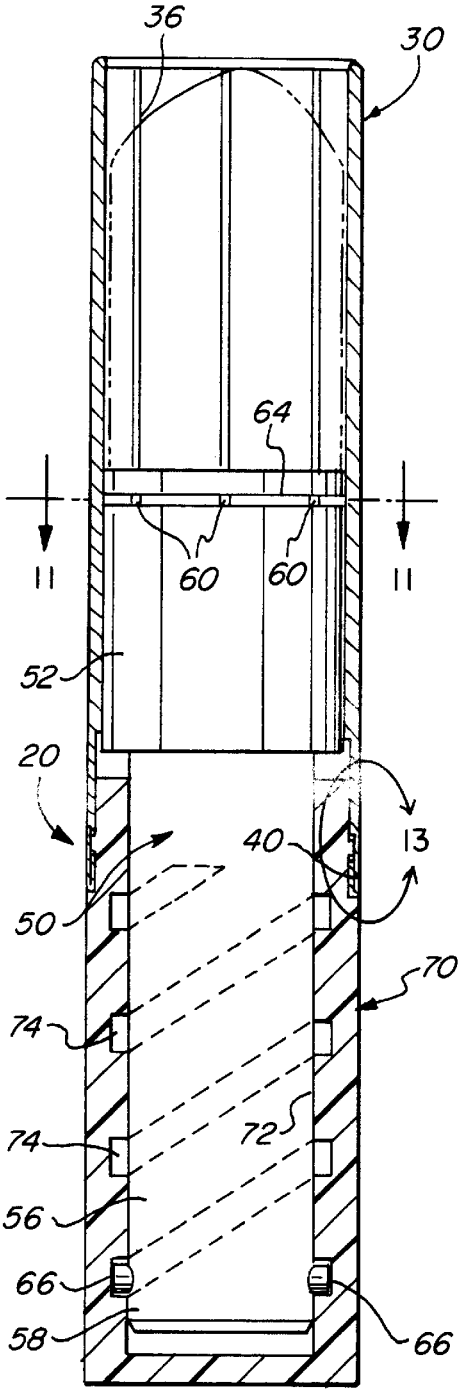
FIG. 1 is a cross-sectional elevation view of a lipstick dispenser in accordance with one embodiment of the invention.
Figure 11:
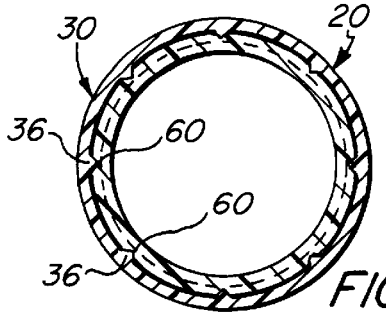
FIG. 11 is a top plan cross-sectional view of the lipstick dispenser of FIG. 1 along the line 11—11.
Figure 12:
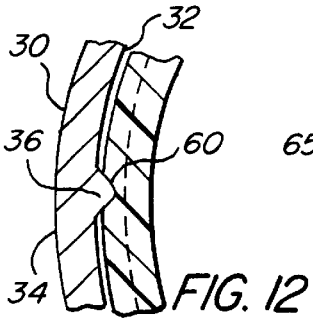
FIG. 12 is a detail of the view of FIG. 11, showing the ribs of the A-shell mating to the bead of the elevator cup.
Figure 10:
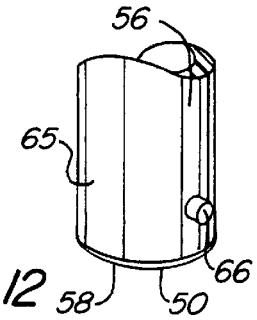
FIG. 10 is a perspective view of the lower end of an embodiment of the elevator of the lipstick dispenser of the invention.

Referring now to FIGS. 1–13, where like elements are indicated with the same element numbers, a cosmetic dispenser in accordance with an embodiment of the invention is shown at 20. Dispenser 20 comprises an A-shell 30, an elevator 50, and a base 70. A-shell 30 is a decorative tubular part, preferably formed of metal, most preferably, aluminum. A-shell 30 has an interior wall 32 and an exterior wall 34. A plurality of longitudinal splines 36 are provided with the interior wall 32 of A-shell 30. Preferably, there are from four to eight such longitudinal splines 36. In one preferred embodiment, the splines 36 are integrally formed with the A-shell 30. This can be manufactured by cold forming the A-shell in an appropriate die. Alternately, as can be seen in FIGS. 7–9, A-shell 30 may be a smooth cylinder, and the splines 36 can be incorporated in a metal or plastic insert 38 that fits inside the A-shell 30.

Elevator 50 is preferably formed from polypropylene and has an elevator cup 52 at an upper end thereof and an elevator stem 56 at a lower end 58 thereof. The elevator cup 52 fits inside the A-shell 30. Elevator cup 52 has a plurality of notches 60 around outer wall 62 of the cup 52. Notches 60 receive the longitudinal splines 36. The splines 36 received in the notches 60 operate to keep the cup 52 fixedly oriented relative to the A-shell 30. Preferably the number of notches 60 is the same as the number of splines 36. The notches 60 may be molded into the outer walls of the elevator cup 52. Preferably, notches 60 are formed in an annular bead 64 extending around the outer wall 62 of the elevator cup. Bead 64 is preferably deformable, and the elevator cup notches 60 can therefore be formed by pressure applied by the splines 36 as they pass over bead 64 when the cosmetic dispenser 20 is first operated. Elevator stem 56 has an exterior wall 65 with a circular cross-section and one or more lugs 66 extending radially outwardly from the wall 65. Preferably, stem 56 is hollow, so that the dispenser 20 may be bottom filled with a cosmetic product.

Figure 13:
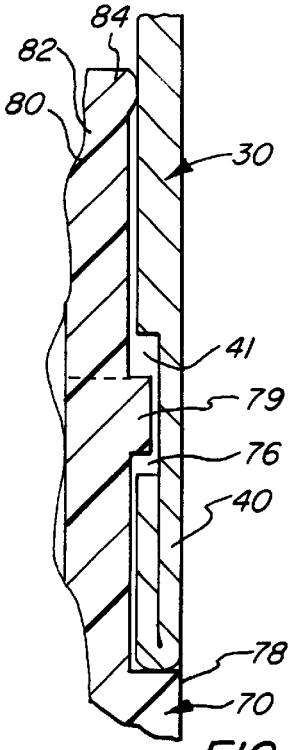
FIG. 13 is a detail side elevation cross-sectional view of the area within line 13—13 of FIG.1.
Figure 6:
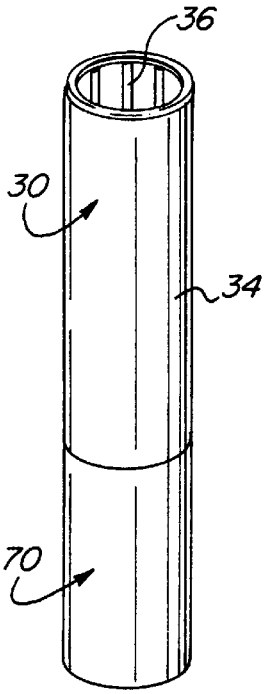
FIG. 6 is a perspective view of an assembled A-shell and cam base of a sealed lipstick dispenser in accordance with one embodiment of the invention.
Figure 2:
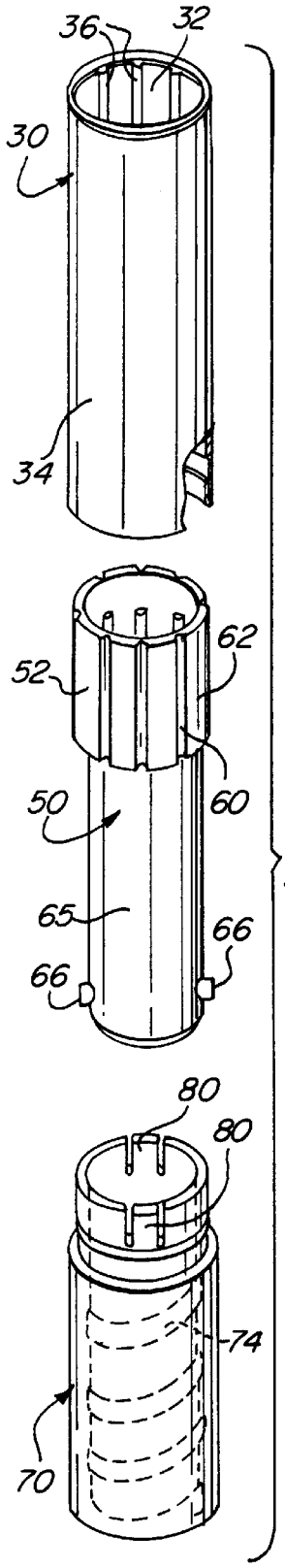
FIG. 2 is a perspective exploded view of a lipstick dispenser in accordance with another embodiment of the invention.
Figure 4:
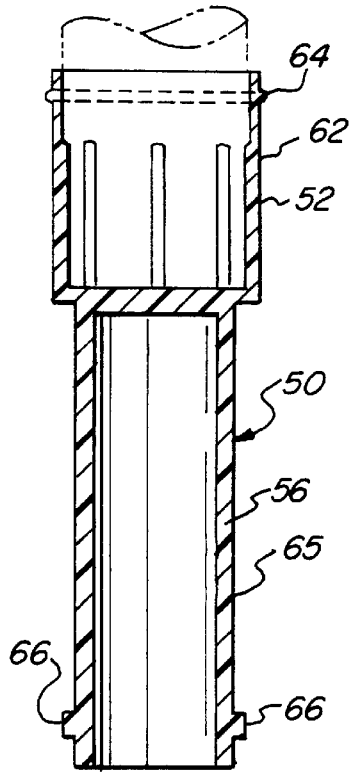
FIG. 4 is a cross-sectional elevation view of an elevator of a lipstick dispenser in accordance with one embodiment of the invention.
Figure 3:
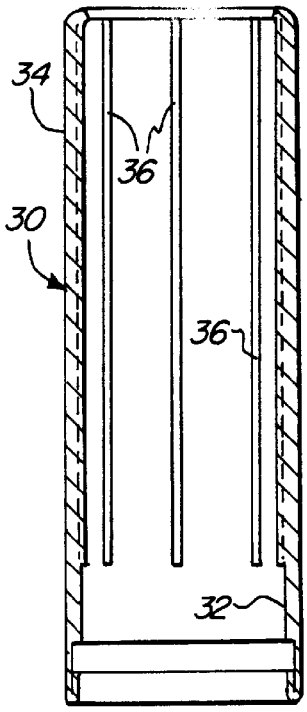
FIG. 3 is a cross-sectional elevation view of an A-shell of a lipstick dispenser in accordance with one embodiment of the invention.
Figure 5:
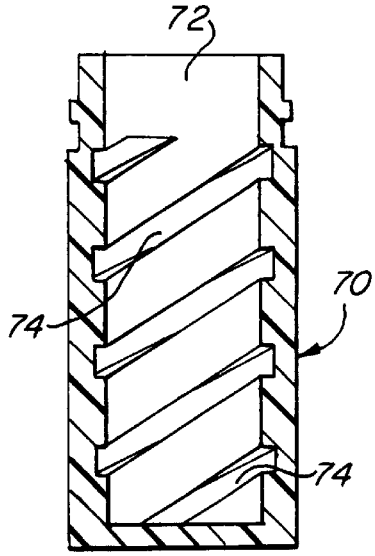
FIG. 5 is a cross-sectional elevation view of a cam base of a lipstick dispenser in accordance with one embodiment of the invention

Base element 70 has an inner wall 72 with a circular cross-section and at least one, and preferably two internally helically threaded track sections 74. Helically threaded track sections 74 are engaged by the lugs 66 on elevator stem 56. Base 70 is rotatably attached to A-shell 30. In one preferred embodiment, Base 70 is attached to A-shell 30 by a folded over wall section 40 forming an annular bead extending around a perimeter of the interior wall 32 of the A-shell 30 in snap fitting engagement with a channel 76 extending around the perimeter of the outer wall 78 of the base 70. Preferably, as seen in FIG. 13, there is also an external bead 79 in base 70 that fits into a channel 41 in A-shell 30. Accordingly, the cosmetic dispenser 20 is operable to cause the elevator cup 52 to travel longitudinally in the A-shell 30 by rotation of the base element 70 relative to the A-shell 30, because the rotation causes the lugs 66 to track upwardly in the helically threaded track sections 74. While the elevator moves upwardly, the A-shell splines 36 received in the elevator cup notches 60 maintain the elevator cup 52 in a fixed orientation relative to the A-shell 30.

It is to be appreciated that the bead 64 fits tightly against the inner wall 32 of the A-shell 30 to provide the necessary sealing fit that prevents leakage or escape of volatile components in the lipstick when the dispenser is closed with a cap and base.

In a preferred embodiment, a desirable swivel torque is provided by at least one, preferably two, or a plurality of separate tabs 80 formed with and extending upwardly from the base 70 into frictional contact with the interior wall 32 of the A-shell 30 to generate friction between the base 70 and the A-shell 30 upon relative rotation of the base 70 and A-shell 30. To provide the desired swivel friction, the tabs, and typically, the entire base 70 should be formed from a suitable plastic that has low creep characteristic and a good lubricity. In a preferred embodiment, the base is fabricated from Delrin®, a PTFE filled acetal manufactured by E.I. du Pont de Nemours and Company. As can be seen in FIG. 13, the tabs 80 are separated from each other and have an upwardly extending segment 82 and a radially extending segment 84. Although friction tabs 80 are believed preferred, other friction elements may be used, as for example a continuous bead, which would provide a sealing ft between the components to preserve the product and prevent it from drying out. Such a continuous bead could for example connect all the segments 84 to create one annular bead, with segments 82 maintained as separate segments. Alternatively, segments 82 could be a continuous web instead of being segmented, just as segments 84 would be a continuous bead instead of being segmented.

It is to be appreciated that the foregoing is illustrative and not limiting of the invention, and that other modifications of the cosmetic dispenser of the invention may be chosen by persons of ordinary skill in the art, all within the scope of the invention as claimed below.

What is claimed is:

1. A cosmetic dispenser, comprising:

a tubular A-shell having an interior wall and an exterior wall, and having a plurality of longitudinal splines provided on said interior wall of said A-shell;

an elevator having an elevator cup at an upper end thereof and an elevator stem at a lower end thereof, said elevator cup being fitted inside said A-shell and having a plurality of notches around an outer wall thereof for receiving said longitudinal splines, wherein said elevator cup notches are formed in a deformable annular bead extending around said outer wall of said elevator cup, said elevator cup notches being formed by deformation of said annular bead caused by said A-shell splines when said cosmetic dispenser is operated, said elevator stem having an exterior wall with a circular cross-section and a lug extending radially outwardly therefrom;

a base element having an inner wall with a circular cross-section and an internal helical track section, said lug being engaged with said internally helical track section, said base element being rotatably attached to said A-shell;

means for generating friction between said base element and said A-shell upon relative rotation of said base element and A-shell;

said cosmetic dispenser being operable to cause said elevator cup to travel longitudinally in said A-shell by rotation of said base element relative to said A-shell, said A-shell splines received in said elevator cup notches maintaining said elevator cup in a fixed orientation relative to said A-shell.

2. A cosmetic dispenser in accordance with claim 1 wherein said splines are integrally formed with said interior wall of said A-shell.

3. A cosmetic dispenser in accordance with claim 1 further comprising an insert fitted inside said A-shell, said splines being provided on said insert.

4. A cosmetic dispenser in accordance with claim 1 wherein said elevator stem is hollow.

5. A cosmetic dispenser in accordance with claim 1 wherein said means for generating friction comprises one or more separate tabs formed with and extending upwardly from said base element into frictional contact with said A-shell interior wall.

6. A cosmetic dispenser in accordance with claim 1 wherein said means for generating friction comprises a continuous bead formed on an outer surface of said base element and in sealing friction fit with said A-shell interior wall.

7. A cosmetic dispenser in accordance with claim 1, wherein said annular bead fits sealingly against said A-shell interior wall.

8. A cosmetic dispenser in accordance with claim 1 wherein said base element is rotatable attached to said A-shell by an annular bead extending around a perimeter of said interior wall of said A-shell in snap fitting engagement with a channel extending around a perimeter of an outer wall of said base element.

9. A cosmetic dispenser in accordance with claim 1 wherein there are from 4 to 8 of said splines.

10. A cosmetic dispenser, comprising:

a tubular A-shell having an interior wall and an exterior wall, and having a plurality of longitudinal splines provided on said interior wall of said A-shell;

an elevator having an elevator cup at an upper end thereof and an elevator stem at a lower end thereof, said elevator cup being fitted inside said A-shell and having a plurality of notches around an outer wall thereof for receiving said longitudinal splines, wherein said elevator cup notches are formed in a deformable annular bead extending around said outer wall of said elevator cup, said elevator cup notches being formed by deformation of said annular bead caused by said A-shell splines when said cosmetic dispenser is operated, said elevator stem having an exterior wall with a circular cross-section and lugs extending radially outwardly therefrom;

a base element having an inner wall with a circular cross-section and an internally helical track section engaged by said lugs provided on said elevator stem, said base element being rotatably attached to said A-shell;

one or more separate tabs formed with and extending upwardly from said base element into frictional contact with said A-shell interior wall for generating friction between said base element and said A-shell upon relative rotation of said base element and A-shell;

said cosmetic dispenser being operable to cause said elevator cup to travel longitudinally in said A-shell by rotation of said base element relative to said A-shell, said A-shell splines received in said elevator cup notches maintaining said elevator cup in a fixed orientation relative to said A-shell.

11. A cosmetic dispenser in accordance with claim 10 wherein said splines are integrally formed with said interior wall of said A-shell.

12. A cosmetic dispenser in accordance with claim 10, further comprising an insert fitted inside said A-shell, said splines being provided on said insert.

13. A cosmetic dispenser in accordance with claims 10, 11 or 12 wherein there are from 4 to 8 of said splines.

14. A cosmetic dispenser in accordance with claim 10 wherein said elevator stem is hollow.

15. A cosmetic dispenser in accordance with claim 10 wherein said base element is rotatable attached to said A-shell by an annular bead extending around a perimeter of said interior wall of said A-shell in snap fitting engagement with a channel extending around a perimeter of an outer wall of said base element.

16. A cosmetic dispenser, comprising:

a tubular A-shell having an interior wall and an exterior wall, and having from 4 to 8 longitudinal splines provided on said interior wall of said A-shell;

an elevator having an elevator cup at an upper end thereof and a hollow elevator stem at a lower end thereof, said elevator cup being fitted inside said A-shell and having a plurality of notches around an outer wall thereof for receiving said longitudinal splines, wherein said elevator cup notches are formed in a deformable annular bead extending around said outer wall of said elevator cup, said elevator cup notches being formed by deformation of said annular bead caused by said A-shell splines when said cosmetic dispenser is operated, said elevator stem having lugs extending radially outwardly from an exterior wall with a circular cross-section;

a base element having an inner wall with a circular cross-section and an internally threaded section engaged with said elevator stem lugs, said base element being rotatably attached to said A-shell by an annular bead extending around a perimeter of said interior wall of said A-shell in snap fitting engagement with a channel extending around a perimeter of an outer wall of said base element;

a plurality of separate tabs formed with and extending upwardly from said base element into frictional contact with said A-shell interior wall for generating friction between said base element and said A-shell upon relative rotation of said base element and A-shell;

said cosmetic dispenser being operable to cause said elevator cup to travel longitudinally in said A-shell by rotation of said base element relative to said A-shell, said A-shell splines received in said elevator cup notches maintaining said elevator cup in a fixed orientation relative to said A-shell.

* * * * *